US006923388B2

(12) United States Patent
Buehler

(10) Patent No.: US 6,923,388 B2
(45) Date of Patent: Aug. 2, 2005

(54) FUEL-INJECTION VALVE FOR INTERNAL COMBUSTION ENGINES

(75) Inventor: Christoph Buehler, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 148 days.

(21) Appl. No.: 10/296,712

(22) PCT Filed: Mar. 26, 2002

(86) PCT No.: PCT/DE02/01091

§ 371 (c)(1),
(2), (4) Date: May 19, 2003

(87) PCT Pub. No.: WO02/077445

PCT Pub. Date: Oct. 3, 2002

(65) Prior Publication Data

US 2003/0173428 A1 Sep. 18, 2003

(30) Foreign Application Priority Data

Mar. 28, 2001 (DE) ..... 101 15 216

(51) Int. Cl.[7] ..... F02M 59/00; F02M 39/00; F02M 61/00; B05B 1/30

(52) U.S. Cl. ..... 239/533.2; 239/533.3; 239/533.12; 239/533.13; 239/585.1; 239/585.3; 239/585.5

(58) Field of Search ..... 239/533.2, 533.3, 239/533.12, 533.13, 585.1–585.5, 88–93, 602; 251/129.15, 129.21, 127

(56) References Cited

U.S. PATENT DOCUMENTS

| | | | | |
|---|---|---|---|---|
| 1,952,816 A | | 3/1934 | Mock | |
| 4,060,199 A | * | 11/1977 | Brune et al. | 239/488 |
| 4,995,559 A | * | 2/1991 | Okamoto et al. | 239/493 |
| 5,098,016 A | * | 3/1992 | Okamoto et al. | 239/5 |

FOREIGN PATENT DOCUMENTS

| | | |
|---|---|---|
| DE | 198 44 638 A1 | 3/2000 |
| DE | 199 44 638 A 1 | 3/2000 |
| DE | 195 31 891 A 1 | 1/2001 |

* cited by examiner

*Primary Examiner*—Davis Hwu
(74) *Attorney, Agent, or Firm*—Ronald E. Greigg

(57) ABSTRACT

A fuel injection valve for internal combustion engines has a valve body in which a pistonlike valve member is longitudinally displaceably disposed in a bore. The valve member is surrounded, over at least part of its length, by a pressure chamber that can be filled with fuel. On its end toward the combustion chamber, a valve seat is embodied in the bore, on which seat the valve member comes to rest with a valve sealing face in a closing position, so that the pressure chamber is disconnected from at least one injection opening located downstream of the valve sealing face. First and second parallel annular grooves are formed in the end region of the valve member disposed axially toward the valve seat and the valve sealing face is disposed between these two annular grooves.

8 Claims, 2 Drawing Sheets

FUEL-INJECTION VALVE FOR INTERNAL COMBUSTION ENGINES

CROSS-REFERENCE TO RELATED APPLICATIONS

This application is a 35 USC 371 application of PCT/DE 02/01091 filed on Mar. 26, 2002.

BACKGROUND OF THE INVENTION

1. Field of the Invention

This invention is directed to an improved fuel injection valve for an internal combustion engine.

2. Description of the Prior Art

A fuel injection valve for internal combustion engines of the type with which this invention is concerned is known for instance from German Patent Disclosure DE 196 18 650 A1. Such a fuel injection valve has a valve body, in which a bore is embodied. A pistonlike valve member is disposed longitudinally displaceably in this bore and on its end toward the combustion chamber has a valve sealing face, which cooperates with a valve seat embodied on the end of the bore toward the combustion chamber. The valve member is surrounded by a pressure chamber embodied in the valve body, and this pressure chamber can be filled with fuel at high pressure and extends as far as the valve seat. At least one injection opening is embodied in the valve seat, which connects the bore and thus the pressure chamber with the combustion chamber of the engine. By means of a longitudinal motion of a valve member, the valve member with its valve sealing face lifts from the valve seat, causing the pressure chamber to communicate with the injection openings. The valve seat is embodied essentially conically, and the tip of the cone forming the conical face is oriented toward the combustion chamber. The valve sealing face of the valve member is correspondingly embodied conically as well, and the valve sealing face has two conical faces with different angles of inclination, so that at the transition between these two conical faces, a sealing edge is formed. In the closing position of the valve member, or in other words when the valve sealing face is resting on the valve seat, this sealing edge is pressed into the valve seat, so that secure sealing off of the pressure chamber from the injection openings is possible.

The valve member is acted upon by a device with a closing force that presses the valve member onto the valve seat. Because of the hydraulic pressure in the pressure chamber, the valve member experiences a force acting in the axial direction, which force is oriented counter to the closing force. If the pressure in the pressure chamber exceeds an opening pressure, then the hydraulic force on the valve member becomes greater than the closing force, and the valve member moves out of its closing position, away from the valve seat. The magnitude of this opening pressure depends, among other factors, on what the diameter of the sealing edge at the valve seat is. A change in the opening pressure causes a change in the injection characteristic of the injection valve, so that for optimal injection, an at least approximately constant opening pressure is indispensable. The known fuel injection valve has the disadvantage in this respect that the sealing edge formed by the transition between the two closing faces is beaten into the valve seat over the course of operation of the fuel injection valve, causing the hydraulically effective sealing line diameter to change over time, and hence the opening pressure does not remain constant. Particularly in modern fuel injection systems, which are optimized for low pollutant emissions, this is a major disadvantage.

SUMMARY AND ADVANTAGES OF THE INVENTION

The fuel injection valve of the invention has the advantage over the prior art that the opening pressure of the fuel injection valve does not change in operation. To that end, the valve member has an end region in which two annular grooves are embodied. The first annular groove is disposed in a radial plane of the longitudinal axis of the valve member, and the second annular groove is offset axially toward the valve seat and is parallel to the first annular groove. This divides the end region of the valve member into three portions, and the valve sealing face is embodied at an annular land that remains between the two annular grooves. The hydraulically effective sealing edge is formed at the transition from the first annular groove to the valve sealing face, whose diameter cannot change over the course of operation of the fuel injection valve.

In an advantageous feature of the subject of the invention, the annular land of the valve member that remains between the two annular grooves and whose outer jacket face forms the valve sealing face is embodied, on its outer edge, resiliently in the longitudinal direction of the valve member. As a result, the valve sealing face can adapt optimally to the valve seat, so that even in the time just before the injection, when because of the rising pressure in the pressure chamber the valve body is widened elastically to some extent, an optimal contact of the valve sealing face with the valve seat is accomplished.

In another feature of the subject of the invention, the first annular groove is always in hydraulic communication with the pressure chamber. The hydraulic pressure in the first annular groove widens it elastically somewhat, so that the annular land of the valve member remaining between the two annular grooves is pressed against the valve seat when the opening stroke motion begins. This assures that the hydraulically effective sealing line diameter is always equivalent to the edge that is formed at the transition from the first annular groove to the valve sealing face. This is true regardless of angular tolerances when the valve is new and regardless of wear over the course of the service life.

In a further advantageous feature, the edges embodied at the transition between the annular grooves and the valve sealing face are rounded or beveled. This lessens the notch effect caused by the pressing of these edges into the valve seat. As a consequence, better high-pressure stability is attained, and the resiliently embodied annular land of the valve sealing face is made capable of a rolling motion on the valve seat in the course of the opening or closing motion.

BRIEF DESCRIPTION OF THE DRAWINGS

One exemplary embodiment of the fuel injection valve of the invention is described herein below, in conjunction with the drawings, in which.

DESCRIPTION OF THE PREFERRED EMBODIMENTS

Figure 1:
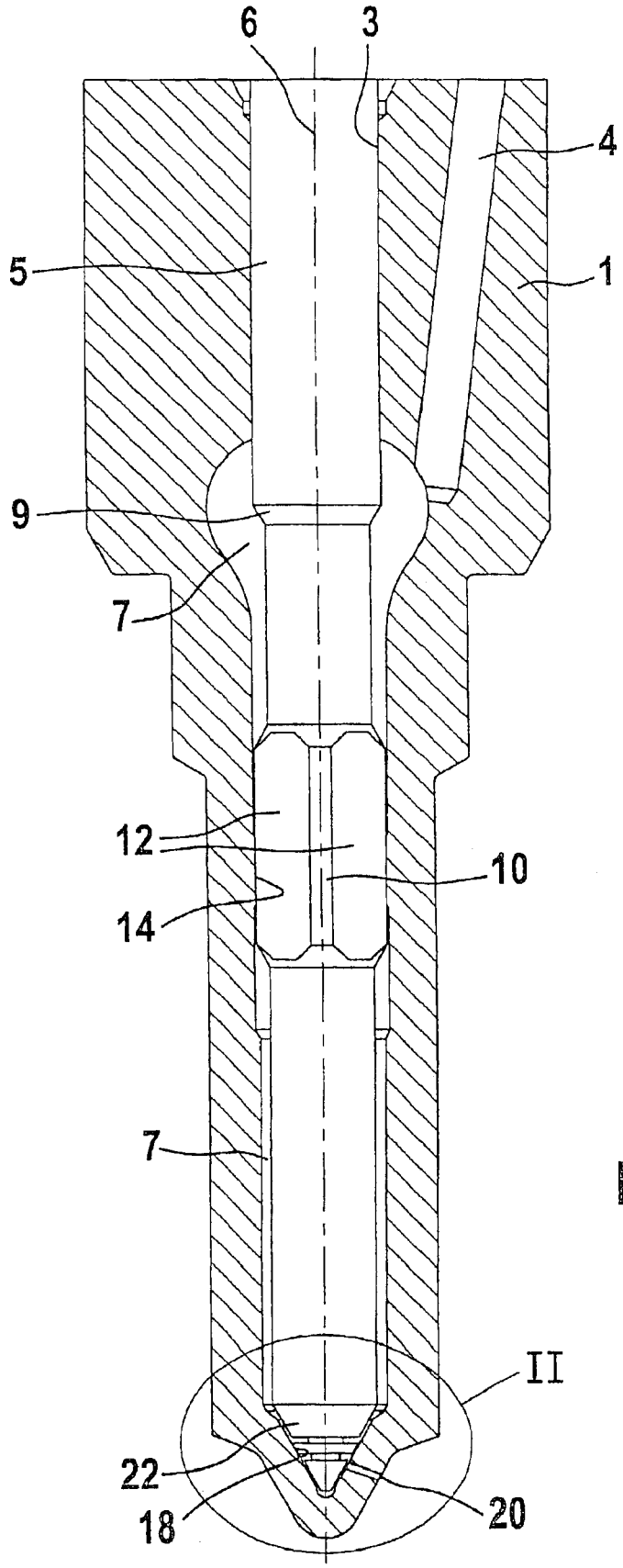
FIG. 1 is a longitudinal section through a fuel injection valve embodying the invention.

In FIG. 1, a longitudinal section is shown through a fuel injection valve of the invention. A valve body 1, which forms part of a fuel injection system for internal combustion engines, has a bore 3, in which a pistonlike valve member 5 that has a longitudinal axis 6 is disposed longitudinally displaceably. In the installed state of the fuel injection valve in the engine, the closed end of the bore 3 is oriented toward the combustion chamber. The valve member 5 is guided sealingly in the bore 3 in a portion remote from the combustion chamber and is tapered toward the combustion chamber, forming a pressure shoulder 9. On its end toward the combustion chamber, the valve member 5 changes into a substantially conical end region 22, which cooperates with a likewise conical valve seat 18 formed on the end of the bore 3 toward the combustion chamber. By means of a radial enlargement of the bore 3, a pressure chamber 7 is formed at the level of the pressure shoulder 9, and the pressure chamber continues, in the form of an annular conduit surrounding the valve member 5, on as far as the valve seat 18. Via an inlet conduit 4 embodied in the valve body 1, the pressure chamber 7 communicates with a high-pressure fuel source, not shown in the drawing, enabling the pressure chamber to be filled with fuel at high pressure. Embodied on the valve member 5 between the pressure shoulder 9 and the end region 22 is a guide portion 10, by which the valve member 5 is guided in a guide region 14 of the bore 3. To assure the flow of fuel from the pressure chamber 7 to the valve seat 18, a plurality of recesses 12, for instance four of them, are disposed on the guide portion 10 and distributed uniformly over the circumference of the valve member 5, making the fuel flow possible. At least one injection opening 20 is embodied in the valve seat 18, connecting the bore 3 to the combustion chamber of the engine. As a result of the longitudinal motion of the valve member 5, the at least one injection opening 20 is uncovered or closed, so that under the control of the valve member 5, fuel from the pressure chamber can reach the combustion chamber of the engine through the injection opening.

The control of the injection activity of the fuel injection valve is accomplished by hydraulic forces. An injection cycle looks like this: By a device not shown in the drawing, the valve member 5 is acted upon by a closing force that presses the valve member 5 with its end region 22 onto the valve seat 18. As a result, the pressure chamber 7 is closed off from the injection openings, and no fuel reaches the combustion chamber of the engine through the injection openings. Introducing fuel at high pressure through the inlet conduit 4 into the pressure chamber 7 results in a hydraulic force in the longitudinal direction of the valve member 5 from action on the pressure shoulder 9 and at least some parts of the end region 22. If these hydraulic forces exceed the closing force on the valve member, the valve member 5 moves away from the valve seat 18, and the end region 22 lifts from the valve seat 18. As a result, the pressure chamber 7 communicates with the injection openings 20, and fuel flows past the valve member 5 to the injection openings 20 and from there into the combustion chamber of the engine. Reducing the fuel inflow causes the pressure in the pressure chamber 7 to drop again, so that as soon as the closing force on the valve member 5 predominates, the valve member 5 moves back into its closing position, in which its end region 22 takes its seat on the valve seat 18. Since the valve member 5 is guided both in the portion remote from the combustion chamber and in the guide portion 10 in the bore 3, a precisely central position of the valve member 5 in the bore 3 is obtained on the valve seat 18 as well, thus assuring a symmetrical flow of fuel to the valve seat 18.

Figure 2:
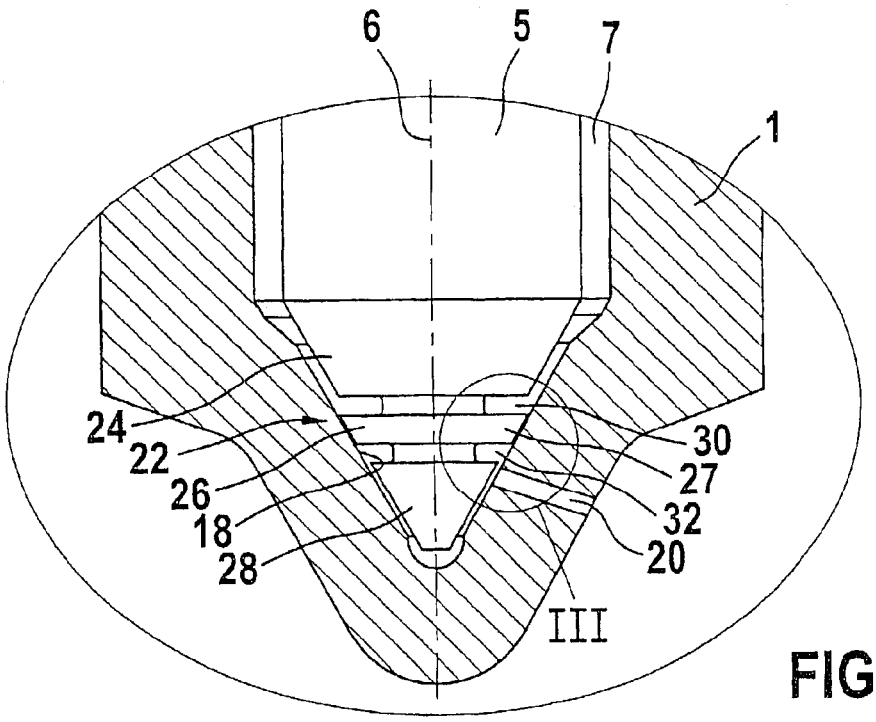
FIG. 2, an enlargement of the detail marked II in FIG. 1.

In FIG. 2, an enlargement of FIG. 1 in a detail marked II is shown. The substantially conical end face 22 of the valve member 5 has a first annular groove 30 and a second annular groove 32 offset axially relative to the first annular groove 30, but the two annular grooves 30, 32 are parallel to one another. The annular grooves 30, 32 are each disposed at least approximately in a radial plane relative to the longitudinal axis 6 of the valve member 5. As a result, the end region 22 of the valve member 5 is divided into three portions, forming a first conical face 24, which directly adjoins the valve member 5; a valve sealing face 26 embodied between the two annular grooves 30, 32; and a second conical face 28, which forms the end toward the combustion chamber of the valve member 5. The valve sealing face 26 is embodied on an annular land 27 that remains between the annular grooves 30, 32. The first conical face 24, the valve sealing face 26, and the second conical face 28 all have at least approximately the same cone angle, but the first conical face 24 and the second conical face 28 are set back somewhat, so that in the closing position of the valve member 5, or in other words when the pressure chamber 7 is closed off from the injection openings 20, only the valve sealing face 26 comes to rest on the valve seat 18. This position is shown in FIG. 2. Because of the set-back first conical face 24, the first annular groove 30 always remains in hydraulic communication with the pressure chamber 7, since between the first conical face 24 and the valve seat 28 a gap always remains.

Figure 3:
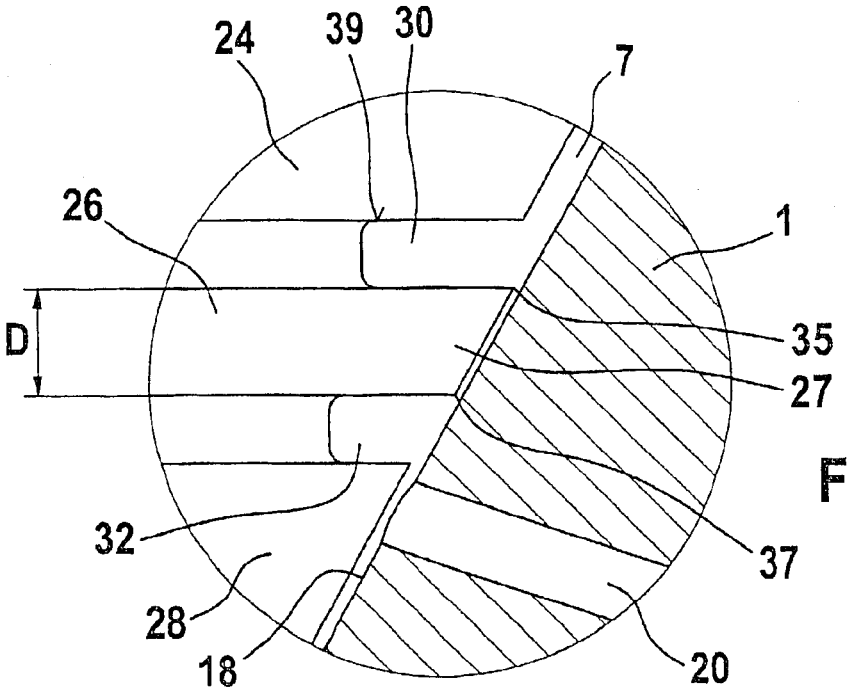
FIG. 3, an enlargement of the detail marked III in FIG. 2.

In FIG. 3, an enlargement of FIG. 2 in the region marked III is shown. Here the valve member 5 is in a slightly open state, and so the valve sealing face 26 does not rest on the valve seat 18. The part of the end region 22 of the valve member 5 that is acted upon hydraulically by the pressure in the pressure chamber 7 corresponds to the first conical face 24 as far as the first edge 35, which is formed at the transition from the first annular groove 30 to the valve sealing face 26 and which forms the sealing line. The hydraulic forces acting in the axial direction on the walls of the first annular groove 30 cancel one another out. Since the annular grooves 30; 32 are cut into the end region 22 of the valve member 5, the annular land 27 between the two annular grooves 30; 32 is embodied resiliently on its outer end, so that upon contact of the valve member 5 with the valve seat 18, the valve sealing face 26 is deformed away from the combustion chamber somewhat, and consequently the sealing face 26 always rests optimally on the valve seat 18. The deformation of the valve sealing face 26 can be so extensive that the second closing face 28, in the closed state of the fuel injection valve, comes to rest on the valve seat 18, which thus limits the deformation of the valve sealing face 26. If the second conical face 28 covers the injection opening 20, then between individual injections the space in the injection valve that communicates with the combustion chamber and is filled with fuel is minimized, with a favorable effect on pollutant emissions from the engine.

The annular land 27 with the valve sealing face 26 embodied on it has a height D in the direction of the longitudinal axis 6 that must be such as to enable elastic deformations without sacrificing the stability of the valve sealing face 26. The height D is therefore preferably from 0.3 mm to 0.5 mm, while the axial height of the annular grooves 30, 32 is approximately 0.2 mm to 0.4 mm.

Besides the exemplary embodiment shown in FIG. 3, it may also be provided that the edges that define the valve sealing face 26, that is, the first edge 35 remote from the combustion chamber and the second edge 37 toward the combustion chamber, are embodied as rounded or beveled. As a result, in the opening motion of the valve member 5, the valve sealing face 26 can roll on the valve seat 18, and as a result, the notch stresses that occur as the edges 35, 37 are pressed into the valve seat 18 are minimized.

The foregoing relates to preferred exemplary embodiment of the invention, it being understood that other variants and embodiments thereof are possible within the spirit and scope of the invention, the latter being defined by the appended claims.

I claim:

1. A fuel injection valve for internal combustion engines, comprising a valve body (1), in which a pistonlike valve member (5) is longitudinally displaceably disposed in a bore (3), the valve member (5) being surrounded, over at least part of its length, by a pressure chamber (7) that can be filled with fuel, and a valve seat (18), embodied on the end toward the combustion chamber of the bore (3), on which seat the valve member (5) comes to rest with a valve sealing face (26) in a closing position, so that the pressure chamber (7) is disconnected from at least one injection opening (20) located downstream of the valve sealing face (18), and first and second parallel annular grooves (30, 32) disposed axially toward the valve seat (18) and embodied in the end region of the valve member (5) toward the combustion chamber, the valve sealing face (26) being disposed on an annular land (27) that remains between these two annular grooves (30; 32), wherein the annular land (27) of the valve member (5) that remains between the annular grooves (30; 32) is resilient in the direction of motion of the valve member (5).

2. The fuel injection valve of claim 1, wherein the valve sealing face (26) is shaped at least approximately conically.

3. The fuel injection valve of claim 2, wherein the first annular groove (30) is constantly in hydraulic communication with the pressure chamber (7).

4. The fuel injection valve of claim 3, wherein the edges (35; 37) formed at the transition from the annular grooves (30; 32) to the valve sealing face (26) are rounded or beveled.

5. The fuel injection valve of claim 2, wherein the edges (35; 37) formed at the transition from the annular grooves (30; 32) to the valve sealing face (26) are rounded or beveled.

6. The fuel injection valve of claim 1, wherein the first annular groove (30) is constantly in hydraulic communication with the pressure chamber (7).

7. The fuel injection valve of claim 6, wherein the edges (35; 37) formed at the transition from the annular grooves (30; 32) to the valve sealing face (26) are rounded or beveled.

8. The fuel injection valve of claim 1, wherein the edges (35; 37) formed at the transition from the annular grooves (30; 32) to the valve sealing face (26) are rounded or beveled.

* * * * *